US007002110B2

(12) United States Patent
Satou et al.

(10) Patent No.: US 7,002,110 B2
(45) Date of Patent: Feb. 21, 2006

(54) ELECTRIC SMOKELESS ROASTER

(75) Inventors: Yoshihiro Satou, Fukuoka (JP); Kazuyuki Hashimoto, Fukuoka (JP); Tomoki Kakitsuka, Fukuoka (JP)

(73) Assignees: Kyushu Electric Power Co., Inc., Fukuoka (JP); Minematsu Electric Machine Co., Ltd., Fukuoka (JP)

( * ) Notice: Subject to any disclaimer, the term of this patent is extended or adjusted under 35 U.S.C. 154(b) by 61 days.

(21) Appl. No.: 10/517,066

(22) PCT Filed: Apr. 22, 2003

(86) PCT No.: PCT/JP03/05057

§ 371 (c)(1),
(2), (4) Date: Dec. 3, 2004

(87) PCT Pub. No.: WO03/103464

PCT Pub. Date: Dec. 18, 2003

(65) Prior Publication Data

US 2005/0167415 A1 Aug. 4, 2005

(30) Foreign Application Priority Data

Jun. 10, 2002 (JP) ..... 2002-169206

(51) Int. Cl.
*H05B 3/68* (2006.01)
*F24B 13/00* (2006.01)

(52) U.S. Cl. ..... 219/450.1; 219/452.11; 219/455.11; 126/299 D

(58) Field of Classification Search ..... 219/450.1, 219/452.11, 452.12, 451.1, 460.1, 455.11; 126/21 R, 21 A, 299 R, 299 D, 299 E; 99/422, 99/423, 428, 444, 445; 415/203, 204, 205, 415/206, 207, 212.1

See application file for complete search history.

(56) References Cited

U.S. PATENT DOCUMENTS

| | | | | |
|---|---|---|---|---|
| 3,587,555 | A * | 6/1971 | Cerola | 126/11 |
| 3,665,914 | A * | 5/1972 | Berger | 126/41 R |
| 4,648,378 | A * | 3/1987 | Nishikawa | 126/21 A |
| 4,750,470 | A * | 6/1988 | Beach et al. | 126/39 R |
| 5,287,799 | A * | 2/1994 | Pickering et al. | 99/446 |
| 5,742,031 | A * | 4/1998 | Kelly et al. | 219/446.1 |
| 6,146,092 | A * | 11/2000 | Botros et al. | 415/119 |

(Continued)

FOREIGN PATENT DOCUMENTS

JP 59-49004 11/1984

(Continued)

*Primary Examiner*—Sang Y. Paik
(74) *Attorney, Agent, or Firm*—Wenderoth, Lind & Ponack, L.L.P.

(57) ABSTRACT

An electric smokeless roaster capable of eliminating ducts installed on the inside and outside of a shop and almost eliminating the generation of harmful gases such as NOx, comprising an electric heater unit (2) installed on the upper part of a casing (1), a water pan (6) installed on the lower part of the heater unit (2), a grill (9) disposed above the heater unit (2), a table (7) installed on the upper surface of the casing (1) and having an opening at the portion thereof corresponding to the grill (9), a suction unit (10) installed around the grill (9) and having suction ports for sucking air around the grill (9), an electric dust collecting unit (30) installed in the casing (1) and dedusting air sucked from the sucking unit (10), and a deodorizer (50) installed in the casing (1) and decomposing odor components contained in the air dedusted by the electric dust collecting unit (30) and exhausting the decomposed odor components to the outside of the casing (1).

18 Claims, 4 Drawing Sheets

U.S. PATENT DOCUMENTS 6,455,818 B1 * 9/2002 Arntz et al. ..... 219/452.11

FOREIGN PATENT DOCUMENTS

| | | |
|---|---|---|
| JP | 60-816 | 1/1985 |
| JP | 61-234822 | 10/1986 |
| JP | 4-51733 | 12/1992 |
| JP | 8307/1993 | 2/1993 |
| JP | 6-319650 | 11/1994 |
| JP | 7-26975 | 6/1995 |
| JP | 2000-279325 | 10/2000 |

* cited by examiner

ELECTRIC SMOKELESS ROASTER

TECHNICAL FIELD

The present invention relates to an electric smokeless roaster which is installed in grilled food restaurants, grilled meat restaurants, and other eating places, and which generates neither smoke nor odor to the inside and outside of the restaurants.

BACKGROUND ART

Grilled meat restaurants or grilled chicken restaurants are filled with smoke and smell of meats or other food materials and the smell stays on clothes and hair, because of which people dressed up in formal attire or expensive coats hesitate to enter these restaurants.

To attract more customers, especially female customers, hooded type roasters, wherein a hood is installed directly above the grill to suck smoke rising from the meat and other food materials placed on the grill, and, smokeless meat roasters, wherein a suction hole is provided on the periphery of the grill to suck smoke generated from the food materials from a side of the grill, have been used.

The former, the hooded type, has the drawbacks that the generated smoke is not completely sucked, and that the air-conditioning efficiency is lowered because the roaster also sucks in the conditioned room air.

The latter, the smokeless meat roaster, has the problem that the moisture on the heated food materials and the room air are also sucked in together with smoke through the suction hole located on the side above the grill, thereby drying up the grilled food materials to harm the taste thereof.

To solve the above problems of the conventional devices, the present inventors have previously disclosed a cooking device with a smoke exhaust system in Japanese Examined Patent Publication No. Sho 59-49004. In a cooking device having its heat source on the lower side, as the smoke generated from food materials rises upwardly, it appears to be generated from the entire surface of the food materials. However, most of the smoke is actually generated from the part of the food materials nearest to the heat source, that is, the underside of the food materials. The invention was made based on the finding. According to the invention, smoke is collected from a suction hole provided around the grill on the lower side thereof and exhausted through a duct. The invention thus provided a cooking device that hardly generates smoke.

However, most of the prior art including the above-mentioned cooking device with a smoke exhaust system disclosed in Japanese Examined Patent Publication No. Sho 59-49004 as well as the above-described hooded type roasters or smokeless meat roasters have a structure wherein the smoke sucked into a duct is directly exhausted to the outdoors. With this system, the smoke and smell exhausted to the outdoors cause a great impact on the surrounding environment. Another problem is that oil components contained in the smoke are adhered to the inside of the duct and steadily accumulated therein. Furthermore, ducts arranged in a complicated layout cannot be cleaned, which leads to constant danger of fire. In addition, large-scale duct installation work is required to open a grilled meat restaurant in a multi-storied building, which sometimes hinders such restaurant from opening.

In some gas roasters, there are non-duct type roasters using an electric dust collector; however, where gas is used as a heat source, generation of $NO_x$ cannot be suppressed with such an electrostatic dust collecting system. Therefore, when the air dedusted by the electric dust collector is exhausted outside (into the interior of the restaurant), it causes irritation and itchiness in eyes, which currently is a problem in actual use.

DISCLOSURE OF THE INVENTION

Therefore, an object that the invention aims to achieve is to provide a smokeless roaster which does not need the duct that was installed inside and outside a restaurant and which hardly generates harmful gasses such as $NO_x$.

To achieve the above object, the invention in a first aspect is an electric smokeless roaster comprising an electric heater unit installed in an upper part of a casing, a water pan provided in a lower part of the heater unit, a grill arranged above the heater unit, a table mounted on an upper surface of the casing and formed with an opening at a position corresponding to the above grill, a suction unit provided on a periphery of the grill and including a suction port for sucking in air around the grill, an electric dust collecting unit provided inside the casing for dedusting air sucked in through the suction unit, and a deodorizer provided in the casing for decomposing odor components contained in the air dedusted by the electric dust collecting unit and for exhausting the air out of the casing.

In this first aspect of the invention, the electric dust collecting unit for catching and collecting oil components contained in the smoke, and the deodorizer for decomposing fine oil mist particles that cannot be caught by the electric dust collecting unit and odor components are provided on the periphery of the food materials placed on the grill part of the roaster, that is, inside the device that sucks in smoke generated from the upper or lower side of the food materials from the suction port and exhausts the smoke to the outside of the casing. The purified smoke is exhausted to the outside of the casing, that is, into the interior of the restaurant. Since smoke purification is completed within the device inside the casing, it is unnecessary to install a duct inside and outside of the restaurant and the equipment therefor. Because the heater unit uses electric power for its heat source, it does not generate combustion gas as with city gas or propane gas, and therefore $NO_x$ is hardly generated. Accordingly, the roaster can be installed in any place where there is an electric power source.

A second aspect of the present invention is that the suction port of the suction unit according to the first aspect is provided on a periphery of the heater unit below the grill. Food materials that are thin and contain high fat, such as sliced meat, generate smoke from the underside where the temperature is the highest. By sucking in the smoke from the suction port of the heater unit below the grill, the smoke is effectively sucked in and removed, and processed to remove the smell. As more food materials are placed on the grill, a negative pressure is created under the grill, whereby the efficiency of the smoke sucking effect is increased.

A third aspect of the present invention is that the suction port of the suction unit according to the first aspect is provided on a periphery above the grill. Some food materials placed on the grill, for example, seafood, which are thick, should be cooked well. Since these food materials do not generate smoke as evidently as meat, by sucking in air from the periphery above the grill, the air passing through the heater unit is made contact with the food materials before it is exhausted, whereby the heating efficiency is increased and the roasting time is shortned.

A fourth aspect of the present invention is that, in the first aspect, a downside type suction unit having a suction port below the grill and an upside type suction unit having a suction port on a periphery above the grill are detachably set in the casing so that they are replaceable. By this structure, using the same main body of the electric smokeless roaster, the suction unit can be replaced and used depending on the menu. For example, the downside type suction unit is attached when grilling meat, while the upside type suction unit is attached when cooking fresh seafood barbecue.

A fifth aspect of the present invention is that the suction port of the suction unit according to the second aspect includes an air director plate protruded on an upper part on the side of the grill. By this structure, smoke that is generated mainly from the underside of the food materials placed on the grill is efficiently sucked in without using a very high suction pressure.

A sixth aspect of the present invention is that the suction unit according to any one of the first to fifth aspects comprises a detachable guide plate for guiding air that is sucked in a horizontal direction from the suction port into a vertical direction, a detachable oil mist collecting chute arranged at a predetermined interval with an exit of the guide plate, a detachable oil tank for accumulating oil collected in the oil mist collecting chute, and a duct for guiding air that has passed through the oil mist collecting chute toward the electric dust collecting unit.

Smoke generated from food materials, in particular, meat, contains a large amount of oil components. As the smoke is sucked into the structure that forms the smoke passage, oil mist is cooled down on the wall surface, and liquefied oil adheres on the wall surface, drips down, and accumulates in a lower part of the smoke passage, which makes oil removal operation become troublesome. According to the above third (sixth に訂正) aspect, smoke is directed into the oil mist collecting chute by the guide plate and liquefied. The liquefied oil travels along the oil mist collecting chute and accumulates in the oil tank. The oil mist is thus liquefied at the entrance of the sucked in smoke passage, which is the part where oil is most likely to adhere. Since the guide plate, the oil mist collecting chute, and the oil tank are detachable, these can be removed after the restaurant is closed to clean off the oil adhered on the guide plate and the oil mist collecting chute and to dispose of the oil accumulated in the oil tank.

A seventh aspect of the present invention is that, in any one of the first to sixth aspects, an oil spout is provided at a side end of the water pan, so that wastewater that has overflowed from the oil spout is collected in a removable wastewater collecting tank accommodated in the casing.

When grilling meat with a meat roaster, as a large amount of oil, sauce, gravy, and others drip onto the water pan below the heater unit, it is necessary to change the water pan with every new customer. If the water pan is left unchanged, it will be dangerous because the water in the water pan evaporates away and the oil or sauce that dropped down might happen to catch fire. Even if the oil or sauce does not catch fire, it will bum onto the water pan or generate a bad smell and, therefore, the water pan should always be replaced with a new one. The changing of water pans was a burden on waiters/waitresses at the peak time of the restaurant as it required troublesome and cautious work when carrying a used water pan and a new water pan walking through coming and going customers. Therefore, the oil spout is provided at one side end of the water pan, and new water is poured into the water pan slowly from the opposite side of this oil spout. This causes the high-temperature wastewater containing much oil, which has a lower specific weight than water, to overflow from the oil spout and be replaced with the new water. The wastewater that has overflowed from the oil spout is collected in the removable wastewater collecting tank accommodated in the casing. When the wastewater collecting tank becomes full, the tank is removed to dispose of the wastewater inside.

An eighth aspect of the invention is that, in the seventh aspect, the water pan is detachable from a side of the casing.

While the water in the water pan is replaced by pouring new water from an upper part during the restaurant's open hours, this does not remove the dirt completely. Therefore, the water pan may be removed in a horizontal direction from the side of the casing to be cleaned after the restaurant is closed or when there are no customers.

A ninth aspect of the invention is that, in any one of the first to eighth aspects, the deodorizer comprises an ozone generating part.

Since the electric dust collecting unit has a powerful oil mist collecting capability, there is hardly any visible gas in the exhaust air. The smell nevertheless remains strongly and, therefore, the odor components are decomposed by ozone generated from the ozone generating part. Unreacted ozone is mostly adsorbed by the active charcoal filter or decomposed by the ozone decomposing catalyst, so that the exhaust air contains residual ozone of 0.06 ppm or lower, which is safe when it is exhausted.

A tenth aspect of the invention is that, in the ninth aspect, the deodorizer alone is operable for a predetermined period of time.

Ozone generated from the ozone generating part has a sterilizing effect in addition to the deodorizing effect. Therefore, after the restaurant is closed, by operating the deodorizer alone for the duration set by a timer or the like, the air is deodorized and sterilized while circulating in the empty restaurant during the closed hours until it is open again.

An eleventh aspect of the invention is that a suction fan is installed between the electric dust collecting unit and the deodorizer according to any one of the first to tenth aspects and that a casing of the deodorizer has a shape that can function as a muffler.

The suction fan would normally be installed downstream of the deodorizer, which is the component in the utmost end; however, by installing the suction fan downstream of the electric dust collecting unit and upstream of the deodorizer, the deodorizer can be used also as a muffler to prevent the suction fan from generating noise inside the restaurant.

BEST MODE FOR CARRYING OUT THE INVENTION

One embodiment of the present invention will be hereinafter described with reference to the drawings.

Figure 1:
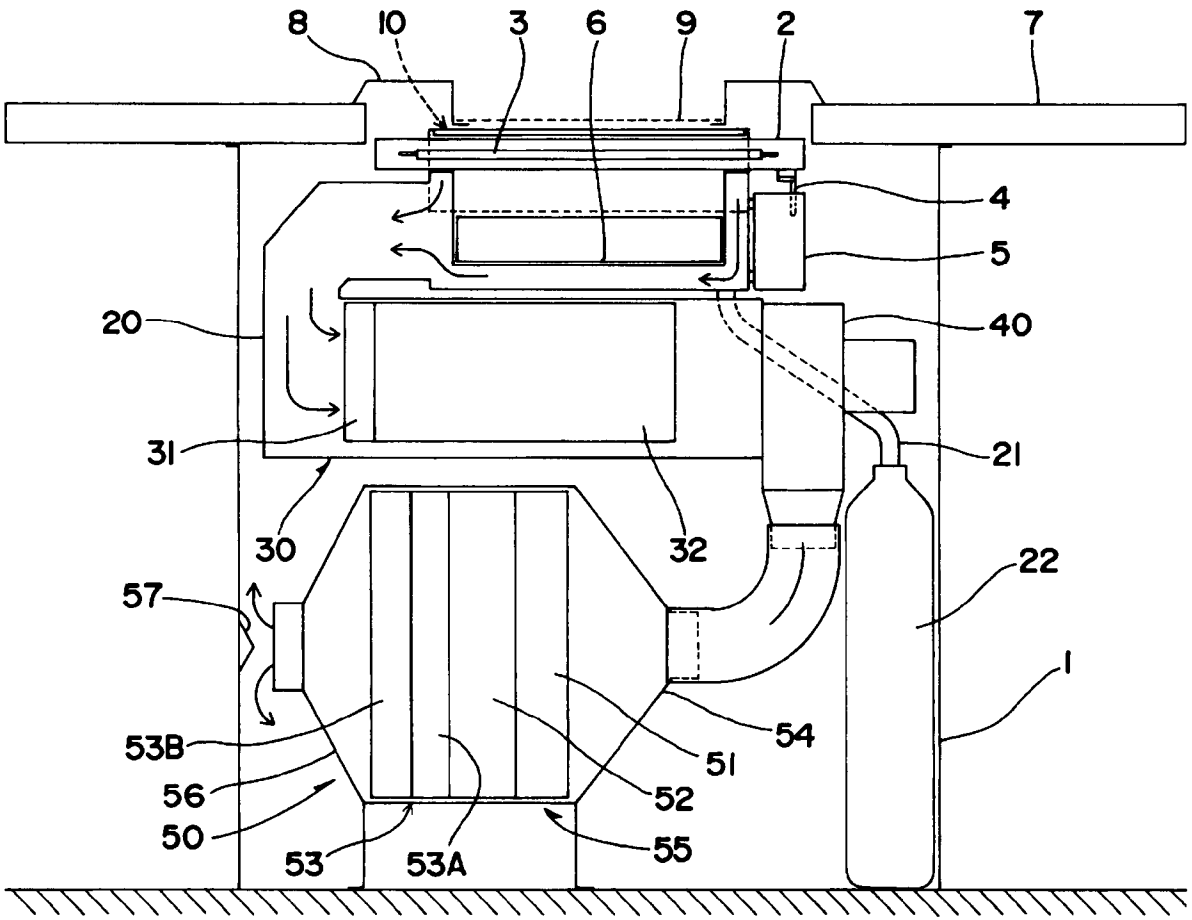
FIG. 1 is a longitudinal cross-sectional view illustrating the entire structure of an electric smokeless roaster according to one embodiment of the present invention.

In this embodiment, as shown in FIG. 1, an electric heater unit 2 is provided in an upper part of a casing 1 that is installed on a floor surface. This heater unit 2 includes four far infrared sheathed heaters 3 arranged in parallel, and is supplied with power by plugging a power receiving terminal 4 into a power source unit 5 from above. In a lower part of the heater unit 2, a water pan 6 that can be set in and removed from the casing 1 in a lateral direction is installed. On the top of the casing 1, a table 7 having an opening at the center thereof is fixed. A frame-like table plate 8 is detachably mounted in the opening of the table 7, and a grill 9 is placed on a flanged part of the opening in the table plate 8.

Figure 2:
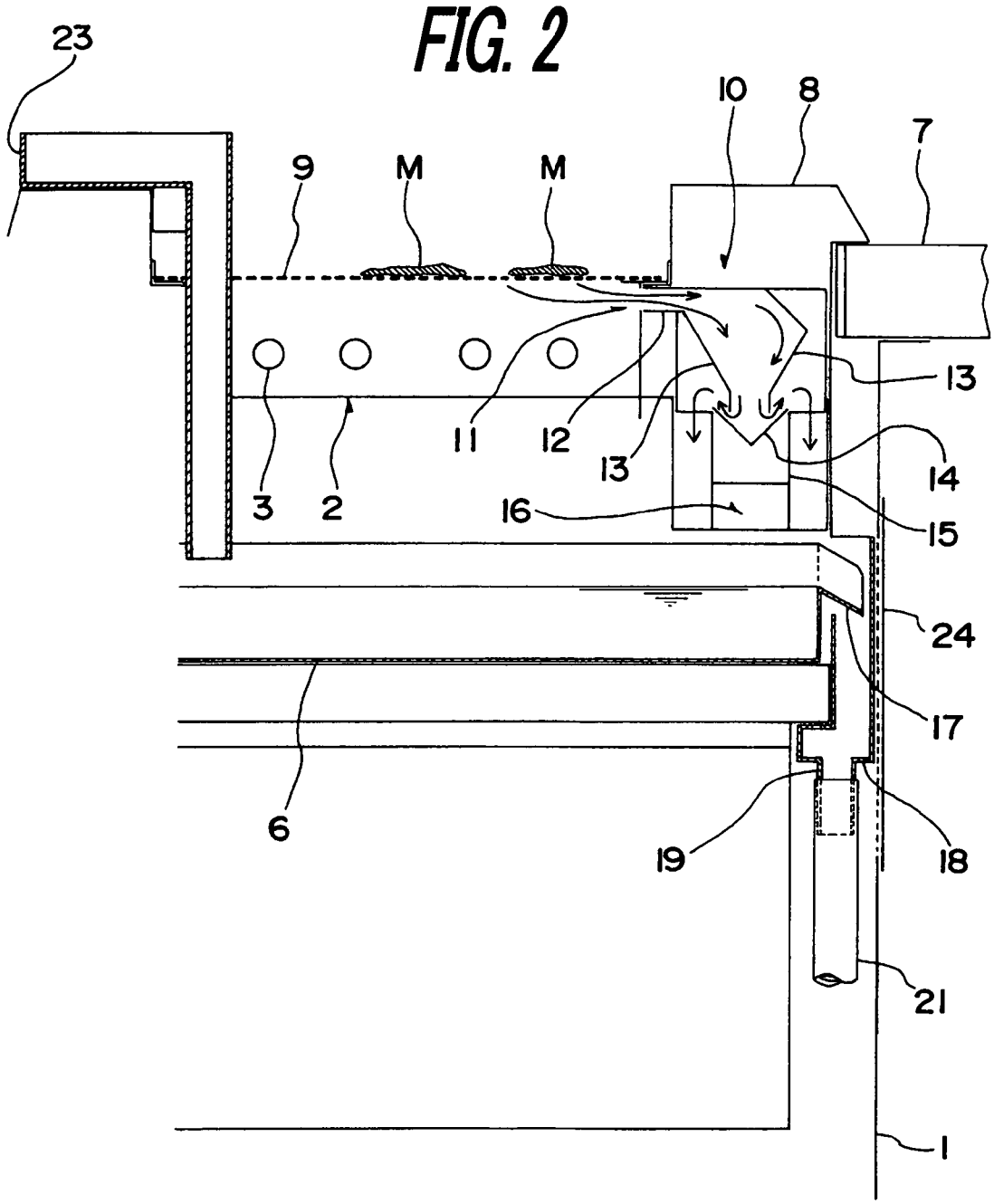
FIG. 2 is an enlarged cross-sectional side view illustrating the suction unit part according to one embodiment of the present invention.

On both sides of the heater unit 2, as shown in FIG. 2, a suction unit 10 having a suction port 11 for sucking in air below the grill 9 is provided. The sucked air passes through the suction unit 10 and flows through a duct 20 and an electric dust collecting unit 30 as shown in FIG. 1. A sirocco fan 40 is arranged downstream of the electric dust collecting unit 30, so that the air that has passed through the electric dust collecting unit 30 is sent to a deodorizer 50.

The structure of the suction unit 10 will be described in more detail with reference to FIG. 2. In the suction port 11 of the suction unit 10 is provided with a horizontal air director plate 12 so that smoke generated from the lower part of the meat M or the like placed on the grill 9 is sucked in intensively and efficiently. The air sucked in horizontal direction is then oriented into a vertical direction by guide plates 13. At an exit of the guide plates 13, an oil mist collecting chute 14 having a V-shaped cross section is arranged at a predetermined interval with the guide plates 13. The oil mist collecting chute 14A has a hole (not shown) at one location in the longitudinal direction thereof, so that liquefied oil is accumulated in an oil tank 15 that supports the oil mist collecting chute 14. Air that has passed through a gap between the guide plates 13 and the oil mist collecting chute 14 flows through side portions of the oil tank 15 and is sucked into the duct 20 (see FIG. 1) through a hole 16. By removing the table plate 8 from the table 7, the suction unit 10 can be disassembled and dismounted from the top so that the oil mist collecting chute 14 and the oil tank 15 can be cleaned.

Next, the structure of the water pan 6 will be described with reference to FIG. 2 and FIG. 3. A beak-like oil spout 17 is protruded at the end on one side of the water pan 6. Liquid that has overflowed from this oil spout 17 flows into a receptor metal fitting 18 provided in the casing 1. A pipe 19 is formed in the lower part of the receptor metal fitting 18, so that the liquid is collected through a hose 21 into a wastewater collecting tank 22 (see FIG. 1) accommodated in the casing 1.

The electric dust collecting unit 30 comprises a pre-filter 31 and a high voltage collector 32, as shown in FIG. 1. The pre-filter 31 removes large-particle dust in the air sucked in from the duct 20 by the sirocco fan 40 so as to ensure that the successive high-voltage collector 32 operates normally. This pre-filter 31 is made of, for example, a combination of aluminum mesh filter and resin-bonded cotton filter, and can be reused after cleaning off adhered dust. The high-voltage collector 32 includes a plurality of electrodes arranged at predetermined intervals, to which positive and negative voltages are applied to electrify particles in the air passing through the electrodes to be positive or negative so that the particles are attracted to the electrodes. The electric dust collecting unit 30 removes most of the particles in the sucked air.

The sirocco fan 40 is provided downstream of the electric dust collecting unit 30 to suck in air. By providing the sirocco fan 40 downstream the electric dust collecting unit 30, adhesion of oil components on the sirocco fan 40 is prevented as much as possible. As the strong smell still remains in the air dedusted by the electric dust collecting unit 30, the air is deodorized by the deodorizer 50 subsequently.

The deodorizer 50 comprises an optical catalyst filter 51, an ozone generating part 52, an active charcoal filter 53A, and an ozone decomposing catalyst 53B. The optical catalyst filter 51 has the functions of oxidizing and decomposing odor, as well as sterilizing, by the strong oxidation effect of active oxygen and hydroxyl radicals that are generated, for example, by irradiating ultraviolet rays to titanium oxide. The ozone generating part 52 generates ozone for deodorization and sterilization. The active charcoal filter 53A performs primary deodorization by the effect of the active charcoal. The ozone decomposing catalyst 53B decomposes remains of the ozone generated from the ozone generating part 52 after deodorization and sterilization so that the concentration of ozone exhausted in the room does not exceed a standard value. The air deodorized by the deodorizer 50 is diffused by a diffusion plate 57 and exhausted out of the casing 1.

Ozone generated from the ozone generating part 52 has a sterilizing effect in addition to the deodorizing effect. Therefore, after the restaurant is closed, by operating the sirocco fan 40 and the deodorizer 50 alone, the air in the empty restaurant is deodorized and sterilized while circulating. The operating time can suitably be set using a timer or the like.

Here, the sirocco fan 40 makes noises when it is driven to rotate. A muffler is normally provided downstream of the deodorizer 50 that is the air exit. However, in this embodiment, the casing of the deodorizer 50 is constructed in the shape of a muffler comprising an expanding horn 54, a drum part 55, and a reducing horn 56, so that the deodorizer also functions as a muffler to make the casing 1 compact.

Next, the operation of this embodiment will be described.

Power is turned on to start operating the heater unit 2, the electric dust collecting unit 30, the sirocco fan 40, and the deodorizer 50. During the cooking, food materials placed on the grill 9 are heated from below by the far infrared sheathed heaters 3 in the heater unit 2. Smoke generated from the lower side of the heated food materials and air containing a large amount of oil components are sucked in a horizontal direction by the function of the air director plate 12 in the suction unit 10, oriented from the suction port 11 into a vertical direction by the guide plates 13, and, as they make contact with the surface of the oil mist collecting chute 14, sucked through the hole 16 into the duct 20.

In the above processes, the high-temperature air containing oil and other components is cooled down on the surfaces of the guide plates 13 and the oil mist collecting chute 14, whereby the oil mist is liquefied and adheres on the surfaces of the guide plates 13 and the oil mist collecting chute 14. The adhered oil travels on the surface of the guide plates 13 and drips down into the oil mist collecting chute 14. The dropped oil travels along a lengthwise direction of the oil mist collecting chute 14 and through the hole (not shown), and accumulates in the oil tank 15. These processes have a dirt preventing effect for the subsequent connecting duct 20 and the effect of extending the duration of continuously operating the dust collector of the electric dust collecting unit 30, which is the main unit for removing oil mist that is present forward of the duct.

After oil has been removed to some extent, the air flows through the duct 20 into the electric dust collecting unit 30, where most of the particle components are collected. However, since odor components still remain at very high concentrations, the air cannot be exhausted to the outside of the casing 1 as it is. Thus, deodorization is performed next using the deodorizer 50. While the optical catalyst filter 51 is used in the first step, it is used secondarily because the decomposition and sterilization of odor components by the optical catalyst proceed at a low speed. Deodorization by the deodorizer 50 is mainly achieved by the odor decomposing effect of ozone generated from the ozone generating part 52. The active charcoal of the active charcoal filter 53A in the next step has an odor adsorption effect and a residual ozone adsorption effect. However, since these absorption effects are decreased when the air temperature is high, this is also used secondarily. Unreacted ozone that remained until the last step is decomposed by the ozone decomposing catalyst 53B.

The air deodorized and made harmless as described above is exhausted out of the casing 1 into the interior of the restaurant.

After cooking for a while, water in the water pan 6 is decreased by evaporation, and oil and burnt pieces dropping from the food materials accumulate in the pan. Then, clean water is poured slowly into the water pan 6 using a pitcher 23 or the like shown in FIG. 2 from the opposite side of the oil spout 17 at one side end of the water pan 6. Thus, high-temperature wastewater containing a large amount of oil that has a lower specific weight than water overflows from the oil spout 17 and is replaced by the new water. The wastewater that has overflowed from the oil spout 17 flows through the receptor metal fitting 18 and the pipe 19, and drops into the wastewater collecting tank 22 accommodated in the casing 1. When the wastewater collecting tank 22 become full, or after the restaurant is closed, it is removed to dispose of the wastewater inside.

Figure 3:
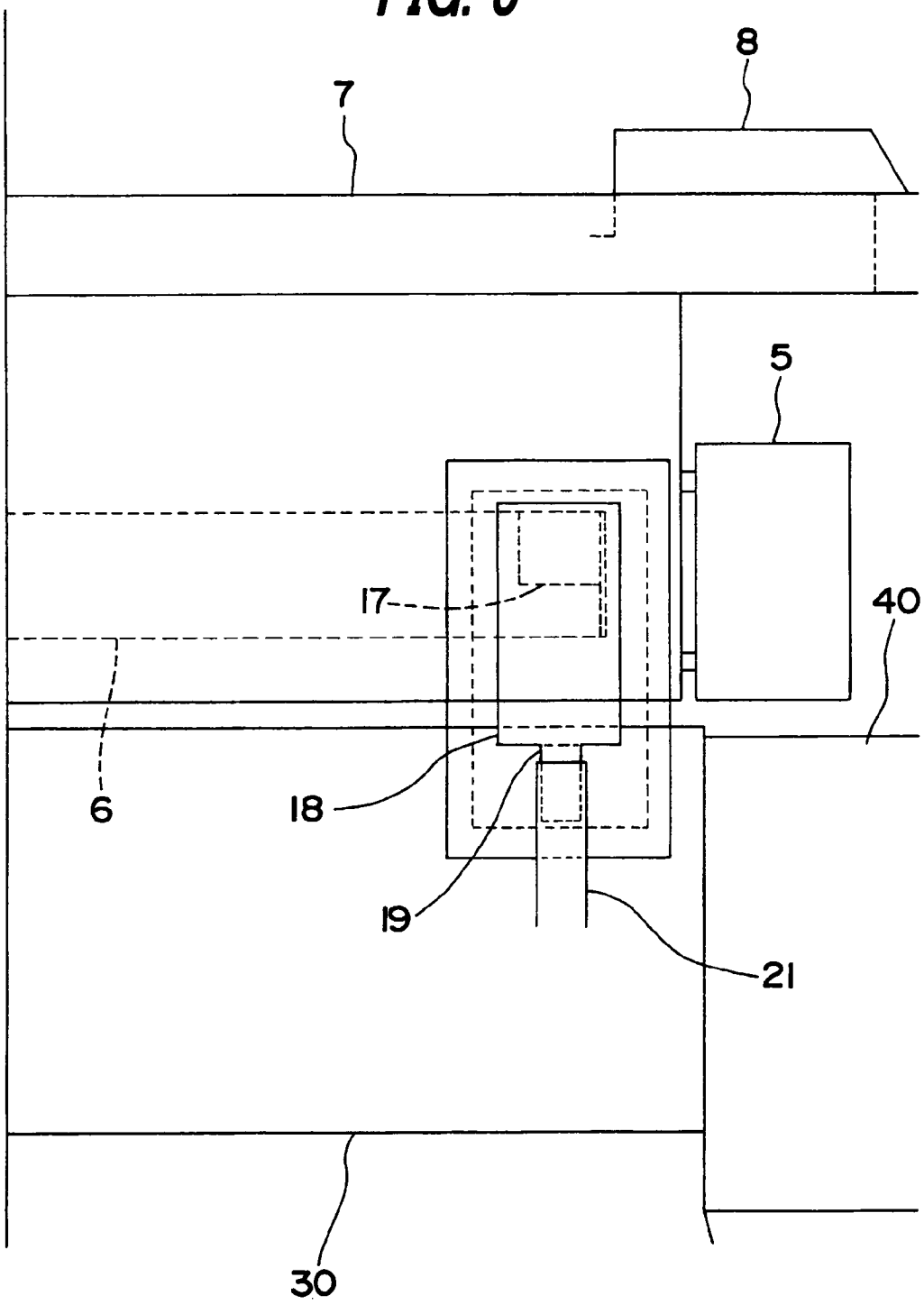
FIG. 3 is an enlarged front view illustrating the suction unit part according to one embodiment of the present invention.
Figure 4:
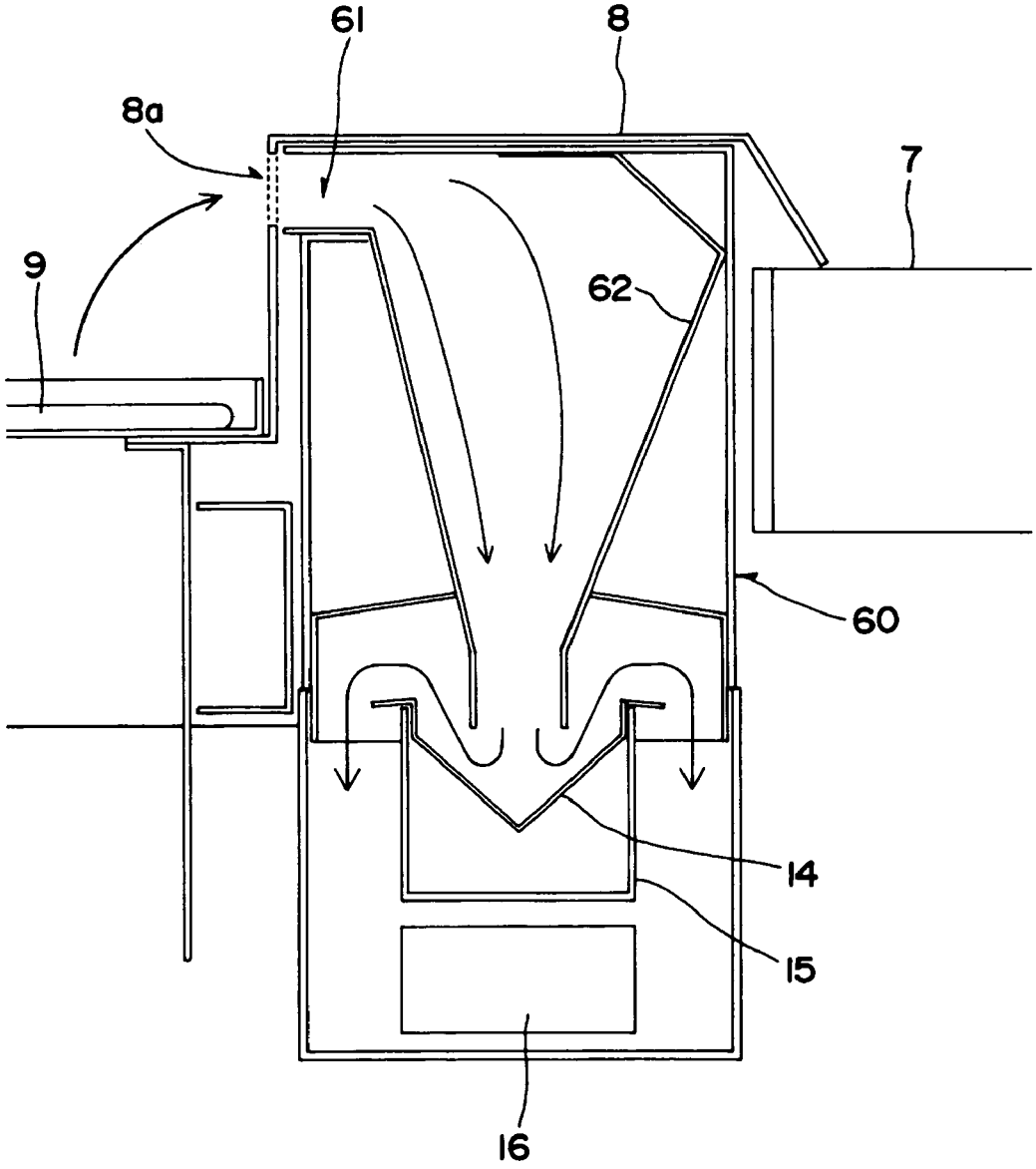
FIG. 4 is an enlarged front view illustrating another example of the suction unit according to one embodiment of the present invention.

The suction unit 10 shown in FIG. 2 and FIG. 3 is a type that sucks in smoke generated from the food materials from the periphery below the grill 9 (hereinafter referred to as "downside type suction unit"), which is suitable for food materials that are thin and contain a large amount of fat such as sliced meat, which are cooked within a short time and generate much smoke. On the other hand, with the downside type suction unit, the heat that is mainly the radiation heat from the heater unit may not readily be conducted to the center or to the upper part of thick food materials, for example, seafood such as fish, scallop, shelled oyster, and turban shell, or chicken thighs. These food materials generally generate less smoke. Therefore, smoke may be sucked in from the periphery above the grill 9 so that heated air is well applied to the food materials. FIG. 4 shows such an upside type suction unit.

In an upside type suction unit 60, a suction port 61 is provided on a periphery above the grill 9. The table plate 8 also has a suction hole 8*a* at a corresponding part. Inside the upside type suction unit 60, a guide plate 62 is provided. Air that has heated the food materials on the grill 9 is sucked in from the suction hole 8*a* and the suction port 61 provided on the periphery above the grill 9, and oriented into a vertical direction by the guide plate 62. At a bottom exit of the guide plate 62, an oil mist collecting chute 14 having a V-shaped cross section is arranged at a predetermined interval with the guide plate 62. The flow of the air thereafter and the dust collecting and deodorizing processes are the same as of the above-described downside type suction unit 10, and the description thereof is omitted.

Accordingly, by selecting the suitable suction type depending on the food materials, it is possible to use either of the suction unit with more weight on the smoke exhaust efficiency or the one with more weight on the heating efficiency. It is also possible to use the same main body of the electric smokeless roaster in one restaurant by setting a suitable one selected from the two types of suction units in accordance with the contents of the ordered menu.

INDUSTRIAL APPLICABILITY

According to the present invention, oil components and solid components contained in exhaust smoke sucked in by the suction unit are electrically dedusted and deodorized to be returned into a room, thereby requiring no exhaust duct for exhausting smoke into the atmosphere. Therefore, the present invention is applicable as an electric smokeless roaster that can be installed only with electric equipment even in a location without smoke exhaust equipment such as places inside a multi-storied building or a hotel.

What is claimed is:

1. An electric smokeless roaster comprising:

an electric heater unit installed in an upper part of a casing;

a water pan provided in a lower part of the heater unit;

a grill arranged above the heater unit;

a table mounted on an upper surface of the casing and formed with an opening at a position corresponding to the grill;

a suction unit provided on a periphery of the grill and including a suction port for sucking in air around the grill;

an electric dust collecting unit provided inside the casing for dedusting air sucked in by the suction unit;

a suction fan provided downstream of the electric duct collecting unit;

a muffler casing comprising an expanding horn provided on an exhaust side of the suction fan, a cross section of an opening on an upstream side of the expanding horn being smaller than a cross section of an opening of a downstream side of the expanding horn, a drum part coupled to the expanding horn on the downstream side, and a reducing horn coupled to the drum part on the downstream side, a cross section of an opening on an upstream side of the reducing horn being larger than a cross section of an opening on a downstream side of the reducing horn; and a deodorizer provided inside the drum part of the muffler casing to decompose odor components contained in the air dedusted by the electric dust collecting unit, said deodorizer comprising an active charcoal filter, an ozone generating part, and an ozone decomposing catalyst.

2. The electric smokeless roaster according to claim 1, wherein the suction port of the suction unit is provided on a periphery of the heater unit below the grill.

3. The electric smokeless roaster according to claim 2, wherein said suction port of the suction unit includes an air director plate protruded on an upper part on the side of the grill.

4. The electric smokeless roaster according to claim 3, wherein said suction unit comprises a detachable guide plate for guiding air that is sucked in a horizontal direction from the suction port into a vertical direction, a detachable oil mist collecting chute arranged at a predetermined distance with an exit of the guide plate, a detachable oil tank for accumulating oil collected in the oil mist collecting chute, and a duct for guiding air that has passed through the oil mist collecting chute toward the electric dust collecting unit.

5. The electric smokeless roaster according to claim 3, wherein an oil spout is provided at a side end of the water pan, so that wastewater that has overflowed from the oil spout is collected in a removable wastewater collecting tank accommodated in the casing.

6. The electric smokeless roaster according to claim 2, wherein an oil spout is provided at a side end of the water pan, so that wastewater that has overflowed from the oil spout is collected in a removable wastewater collecting tank accommodated in the casing.

7. The electric smokeless roaster according to claim 1, wherein said suction port of the suction unit is provided on a periphery above the grill.

8. The electric smokeless roaster according to claim 7, wherein said suction unit comprises a detachable guide plate for guiding air that is sucked in a horizontal direction from the suction port into a vertical direction, a detachable oil mist collecting chute arranged at a predetermined distance with an exit of the guide plate, a detachable oil tank for accumulating oil collected in the oil mist collecting chute, and a duct for guiding air that has passed through the oil mist collecting chute toward the electric dust collecting unit.

9. The electric smokeless roaster according to claim 7, wherein an oil spout is provided at a side end of the water pan, so that wastewater that has overflowed from the oil spout is collected in a removable wastewater collecting tank accommodated in the casing.

10. The electric smokeless roaster according to claim 1, wherein a downside type suction unit having a suction port below the grill and an upside type suction unit having a suction port on a periphery above the grill are detachably set in the casing so that they are replaceable.

11. The electric smokeless roaster according to claim 10, wherein said suction unit comprises a detachable guide plate for guiding air that is sucked in a horizontal direction from the suction port into a vertical direction, a detachable oil mist collecting chute arranged at a predetermined distance with an exit of the guide plate, a detachable oil tank for accumulating oil collected in the oil mist collecting chute, and a duct for guiding air that has passed through the oil mist collecting chute toward the electric dust collecting unit.

12. The electric smokeless roaster according to claim 10, wherein an oil spout is provided at a side end of the water pan, so that wastewater that has overflowed from the oil spout is collected in a removable wastewater collecting tank accommodated in the casing.

13. The electric smokeless roaster according to claim 1, wherein said suction unit comprises a detachable guide plate for guiding air that is sucked in a horizontal direction from the suction port into a vertical direction, a detachable oil mist collecting chute arranged at a predetermined distance with an exit of the guide plate, a detachable oil tank for accumulating oil collected in the oil mist collecting chute, and a duct for guiding air that has passed through the oil mist collecting chute toward the electric dust collecting unit.

14. The electric smokeless roaster according to claim 13, wherein an oil spout is provided at a side end of the water pan, so that wastewater that has overflowed from the oil spout is collected in a removable wastewater collecting tank accommodated in the casing.

15. The electric smokeless roaster according to claim 1, wherein an oil spout is provided at a side end of the water pan, so that wastewater that has overflowed from the oil spout is collected in a removable wastewater collecting tank accommodated in the casing.

16. The electric smokeless roaster according to claim 15, wherein said water pan is detachable from a side of the casing.

17. The electric smokeless roaster according to claim 1, wherein said deodorizer alone is operable for a predetermined period of time.

18. The electric smokeless roaster according to claim 2, wherein said suction unit comprises a detachable guide plate for guiding air that is sucked in a horizontal direction from the suction port into a vertical direction, a detachable oil mist collecting chute arranged at a predetermined distance with an exit of the guide plate, a detachable oil tank for accumulating oil collected in the oil mist collecting chute, and a duct for guiding air that has passed through the oil mist collecting chute toward the electric dust collecting unit.

* * * * *